US011434893B2

(12) United States Patent
Bartels et al.

(10) Patent No.: US 11,434,893 B2
(45) Date of Patent: Sep. 6, 2022

(54) MICROBLOWER

(71) Applicant: BARTELS MIKROTECHNIK GMBH, Dortmund (DE)

(72) Inventors: Frank Bartels, Hattingen (DE); Anja Strube, Dortmund (DE); Florian Siemenroth, Dortmund (DE)

(73) Assignee: BARTELS MIKROTECHNIK GMBH, Dortmund (DE)

( * ) Notice: Subject to any disclaimer, the term of this patent is extended or adjusted under 35 U.S.C. 154(b) by 0 days.

(21) Appl. No.: 17/271,142

(22) PCT Filed: Aug. 23, 2019

(86) PCT No.: PCT/IB2019/057118
§ 371 (c)(1),
(2) Date: Feb. 24, 2021

(87) PCT Pub. No.: WO2020/039399
PCT Pub. Date: Feb. 27, 2020

(65) Prior Publication Data

US 2021/0199106 A1 Jul. 1, 2021

(30) Foreign Application Priority Data

Aug. 24, 2018 (DE) ..... 10 2018 120 782.4

(51) Int. Cl.
*F04B 43/04* (2006.01)
*F04B 45/047* (2006.01)
(Continued)

(52) U.S. Cl.
CPC ..... *F04B 43/046* (2013.01); *F04B 43/0027* (2013.01); *F04B 45/043* (2013.01); *F04B 45/047* (2013.01); *F04B 53/16* (2013.01)

(58) Field of Classification Search
CPC .. F04B 43/046; F04B 43/0027; F04B 45/043; F04B 45/047; F04B 53/16
See application file for complete search history.

(56) References Cited

U.S. PATENT DOCUMENTS 2,029,374 A * 2/1936 Houston ..... F04B 45/047 200/83 T
6,309,189 B1 10/2001 Rey-Mermet et al.
(Continued)

FOREIGN PATENT DOCUMENTS

DE 102012101861 A1 9/2013
EP 2090781 B1 8/2018
WO 2013/187270 A1 12/2013

OTHER PUBLICATIONS

PCT/IB2019/057118 International Search Report and Written Opinion dated Dec. 12, 2019.

*Primary Examiner* — Charles G Freay
(74) *Attorney, Agent, or Firm* — Wagenknecht IP Law Group PC

(57) ABSTRACT

A micropump and its use, the micropump including a vibration unit with piezo actuator, which is arranged on an vibration diaphragm, a vibration plate arranged opposite the vibration diaphragm and having a blower opening, as well as a wall arranged between the vibration diaphragm and the vibration plate, so that a blower chamber is formed, and a housing, in which the vibration unit is mounted, with an suction opening, as well as an output opening, which lies opposite the blower opening. The housing forms a closed space and has at least one suction opening arranged radially, or on an underside opposite the vibration unit, with a suction channel leading into a pump chamber located between the vibration plate and the inside of the housing.

12 Claims, 4 Drawing Sheets

(51) Int. Cl.

| | |
|---|---|
| ***F04B 45/04*** | (2006.01) |
| ***F04B 43/00*** | (2006.01) |
| ***F04B 53/16*** | (2006.01) |

(56) References Cited

U.S. PATENT DOCUMENTS

| | | | | |
|---|---|---|---|---|
| 8,596,998 | B2 * | 12/2013 | Fujisaki | F04B 45/047 92/96 |
| 2006/0245947 | A1 * | 11/2006 | Seto | F04B 53/16 417/410.1 |
| 2009/0167109 | A1 * | 7/2009 | Tomita | G11B 33/142 310/317 |
| 2011/0076170 | A1 | 3/2011 | Fujisaki et al. | |
| 2016/0010636 | A1 * | 1/2016 | Tanaka | F04B 53/08 417/413.2 |
| 2017/0143879 | A1 * | 5/2017 | Okaguchi | A61M 1/064 |

* cited by examiner

MICROBLOWER

CROSS REFERENCE TO RELATED APPLICATIONS

This is a US national phase application under 35 USC § 371 of international patent application no. PCT/IB2019/057118, filed Aug. 23, 2019, which itself claims priority to German application no. 10 2018 120 782.4, filed Aug. 24, 2018. Each of the applications referred to in this paragraph is herein incorporated by reference in its entirety.

TECHNICAL FIELD

The invention relates to a miniaturized pump for compressible fluids and more specifically to a microblower for gases or gas mixtures such as, in particular, air.

BACKGROUND OF THE INVENTION

Micropumps are well known from the state of the art. According to one definition, they are used to pump fluids (liquids and gases) of low volumes. These are typically in the range of micro to milliliters per minute.

In addition to the volume of fluid pumped per unit of time, however, the size of the pump, in particular its pump housing, can also be a decisive factor in determining whether a micropump is present. In this respect, the term "micropump" also refers to a particularly small housing, which has edge lengths ranging from a few millimeters to a few centimeters. Frequently, components such as power supply and control are kept separately from said housing, which is why the term "micropump" in the narrower sense is limited to the components required for the actual pumping (pump chamber, valves, housing therefor). In particular, such a micropump is also an object of the present invention.

Micropumps suitable in particular for pumping incompressible fluids (liquids) are based on the so-called peristaltic principle. Two or more alternately oscillating piezoceramic disks rhythmically increase and decrease the volume of two pump chambers adjoining them. The direction of flow is determined by clever coupling of the chambers by means of movable check valves and a control phase shift. By varying the stroke or the oscillation frequency, the pump can convey a range of liquid volumes.

Although micropumps of this type are basically suitable for pumping both liquids and gases, their inertia causes the valves to limit the pumping frequency when the micropump is in operation. In addition, they are subjected to a constant, usually high-frequency load, which is demanding with respect to their mechanical properties. Another disadvantage is the noise emission due to the drive of the pump. At frequencies above approx. 300 Hz, these are clearly audible even with small dimensions, and at frequencies above approx. 1000 Hz the noise emission rises to a level that is intolerable in many application scenarios. Operation above the audible threshold of approx. 20 kHz is not possible due to the inertia of the valves. Accordingly, there is a practical limit to the flow rate.

Furthermore, micropumps are known which dispense with mechanical valves. Instead, they are operated in a narrow frequency range, preferably the resonant frequency of 1st order or higher. They are designed in such a way that fluid-dynamic effects come become relevant at the operating frequency, resulting in the formation of a preferred direction when pumping the fluid. For example, micropumps are known from publication DE 11 2013 002 723 T5, publication US 2011/0076170 A1 and publication US 2016/0377072 A1, which are operated under high frequencies, preferably in the non-audible range. The single actuator, which is present in the form of a piezoelectric disk, is mounted on a diaphragm that provides passage openings for the fluid to be pumped. Chambers filled with fluid are provided on both sides of the diaphragm. The flow conditions during operation of the pump result in a varying fluid resistance in the corresponding chamber, depending on the of the diaphragms' oscillation direction. In this way, the fluid is conveyed in the desired direction.

A variation of the principle, in particular for conveying gases, is disclosed in EP 2 306 018 A1. A piezo disk together with a diaphragm to which it is attached forms a vibration plate. On the side facing away from the piezo disk, a hollow chamber is arranged. It has a central opening. The vibration unit consisting of vibration plate and hollow chamber is elastically mounted in an outer housing which is open to the side of the piezo disk, so that the entire vibration unit can oscillate in the direction of curvature of the piezo disk by which it is driven. The outer housing has, also centrally, an output opening. An air gap exists between the vibration unit and the inside of the outer housing. The part of the air gap that leads into the region surrounding the side walls of the hollow chamber, which run perpendicular to the surface of the piezo disk, serves as the inlet opening.

If the piezo disk, and with it the entire vibration unit, is now set into oscillations, preferably at resonant frequency, gas is drawn in through the inlet opening and the adjoining, aforementioned region in an intake phase. The required vacuum forms in the successively enlarging region between the central opening of the hollow chamber and the output opening. In the subsequent output phase, this region decreases again. By suitable design of the air gap and the size of the centric opening in the hollow chamber and outer housing, the above-mentioned fluid dynamic effects can be utilized, and a preferred direction can be formed in which the gas is transported.

A disadvantage of the design shown is the fact that the piezo disk is located in the region of the outer housing that is open to the outside, and that gas must also flow around it during operation. Mechanical damages, or impairments by environmental influences (air humidity, aggressive gases, etc.) thus cannot be excluded. In addition, the inlet and outlet openings are located on opposite sides of the micropump. In certain cases this can be disadvantageous, for example if the micropump is to be mounted on a "fluidic circuit board" in which fluid-carrying channels are present. Also, the air gap present between the vibration unit and the inside of the outer casing enlarges the outer casing, or reduces the space available for the vibration unit.

A further development of this micropump, which is intended in particular for gases, is known from publication DE 10 2012 101 861 A1. According to this, the pump has a gas-permeable but liquid-impermeable fabric over the suction region, which is preferably capable of oscillating, to prevent impairment by dust or liquids drawn in with the gas during operation. However, said protection also reduces the delivery capacity of the micropump, since part of the power is now required for transporting the gas through the fabric, which has a certain flow resistance.

Another solution, comparable in parts to the micropump with hollow chamber, is known from publication EP 2 090 781 B1. Here, the piezo disk is also located on the outside of a hollow chamber with a central opening, but this chamber cannot vibrate as a whole; only the wall which is present in the form of a vibration diaphragm, to which the piezo disk is attached, can vibrate. Beyond the wall that is opposite to this wall and has the centric opening, another wall is arranged spaced apart, which has the centric exit opening. The gap between the latter walls serves as the inlet opening. If the diaphragm is set into vibration, the internal pressure in the hollow chamber changes, which is propagated through the centric opening into the aforementioned gap. There, a negative pressure causes gas to be sucked into the gap, and a subsequent positive pressure causes the gas to be blown out, preferably through the output opening.

SUMMARY OF THE INVENTION

Accordingly, the object of the invention is to provide a device and a method which avoids the disadvantages of the prior art. Accordingly, a micropump for compressible fluids according to the invention shall have an improved insensitivity to mechanical and other external impairments. It should be suitable for mechanical connection to a surface and also allow improved utilization of the construction volume.

The object is solved by a device according to claim 1 and a method according to the independent claim 9. Advantageous embodiments can be found in the respective dependent claims, the following description, and the figures.

In the following, the micropump according to the invention and advantageous embodiments thereof are first described. This is followed by a description of its use.

The micropump according to the invention is used to convey compressible fluids such as, in particular, gases.

The micropump comprises two main units, which, however, must not be considered independently of each other, but must be closely coordinated to form a common whole in order to ensure the desired fluid transport.

The first main unit is hereinafter referred to as the "vibration unit" because (in the idealized case) it is the only unit in motion during operation. The vibration unit comprises a disk-shaped, usually round or rectangular piezo actuator, which typically has a diameter of a few (e.g. 1-5) millimeters up to a few (e.g. 1-4) centimeters, and which, when actuated, i.e. when a suitable voltage is applied, goes from a typically flat resting state to a typically curved deflection state. If applicable, a curvature in the opposite direction can be produced by applying an oppositely poled voltage, which increases the usable stroke accordingly.

The piezo actuator is arranged on the inside and/or outside of a vibration diaphragm. It is firmly connected to the diaphragm so that the diaphragm also performs the curvature described above. It is also conceivable to design the piezo actuator and vibration diaphragm as a single unit, or even to regard the latter as a subunit of the piezo actuator. The inner side is the side facing the blower chamber described below.

A vibration plate is arranged opposite the inside of the vibration diaphragm. Depending on the embodiment, this will preferably also move during operation. The vibration plate has at least one centrally arranged blower opening. If it has several blower openings, they are preferably also located in the central region.

Between the vibration diaphragm and the vibration plate a circumferential wall is arranged which is connected to both in a substantially gas-tight manner, so that a blower chamber is formed inside the vibration unit. The vibration unit is thus hollow on the inside, and the hollow space, i.e. the blower chamber, has (at least) one opening through which the fluid can flow in and out again.

The second main unit is hereinafter referred to as the "housing". The vibration unit can be completely accommodated in this housing, whereby a gap surrounding the vibration unit is present. This is necessary because the vibration unit is oscillatingly mounted in the housing in the direction of oscillation of the piezo actuator by means of at least one suspension, it being clear that the gap is to be dimensioned such that no collision can occur between the vibration unit and the housing during normal operation.

The suspension is designed to vibrationally decouple the vibration unit from the housing surrounding it. In this way, the efficiency of the micropump is increased, since no energy is lost due to (undesired) movement (i.e. resonance) of the housing.

The housing has at least one inlet or suction opening. Fluid can flow through it into the interior of the housing.

The housing has (at least) one output opening, which is also arranged centrally, and is thus opposite the blower opening. There is a gap between the two openings which is at least large enough to prevent collision between the vibration unit and the housing during normal operation.

According to the invention, the housing forms a closed space that also covers the piezo actuator and thus protects it from environmental influences. In particular, the outward-facing side of the oscillating diaphragm, and with it the piezo actuator, are also covered by the housing.

According to the invention, the suction opening is also arranged radially (and thus perpendicular to the direction of oscillation of the piezo actuator), or on an underside opposite the vibration unit. It has a suction channel that leads into a "pump chamber" located between the vibration plate and the inside of the housing.

During oscillating operation of the piezo actuator, the vibration unit can be set into oscillation relative to the housing, whereby the compressible fluid can be sucked in through the suction opening and discharged through the output opening.

The invention thus avoids the disadvantages known from the prior art. Since the piezo actuator is completely surrounded by the housing, the latter protects it from undesirable mechanical interference and environmental influences. However, the protection is only possible due to the design according to the invention, since here the fluid does not flow through an suction opening which leads past the piezo actuator, as is partly practiced in the prior art. Since the suction opening is not opposite, but on the side of, or on the same side as the output opening, the micropump according to the invention can also be mounted on a plate without closing any of the openings, or without the need for one or even more corresponding holes for the openings in the plate. Finally, the micropump according to the invention makes optimum use of the construction volume available to it, since the gap present at the side (in the region of the wall) needs only be large enough so that the oscillating motion of the vibration body is not impeded; since the motion is parallel to the (lateral) inner wall of the housing, a smallest gap, for example of 10-1000 μm, is sufficient. In contrast, the air gap according to designs known from the prior art must be sufficiently large for gas transport, which results in a significantly larger gap and thus, at comparable conveying capacity, a larger housing.

Various embodiments of the invention are described in more detail below.

According to one embodiment, the housing has a housing body and a housing cover. The housing body then has a pot-like shape with a base and circumferential walls.

According to one variant of this embodiment, the housing body is set up to accommodate all moving components including the gaps required for oscillation. As a result, this allows the use of a very flat housing cover. In addition, all movable components can be inserted one after the other into the housing body during manufacture and the housing can finally be closed with the housing cover. The cover can also be simply shaped, i.e. without recesses.

According to another variant of this embodiment, at least parts of the movable components are arranged in an interior recess of the housing cover, or they move into and out of it in an oscillating manner, at least during operation. This means that the housing body can be flatter, since the cover also provides space to accommodate certain components. The production of housing parts of approximately the same thickness can be advantageous, particularly in the case of injection molded parts, or in the case of simultaneous production of both parts using 3D printing.

According to one embodiment of the vibration unit, the vibration plate and wall are manufactured in an integrated manner. Both components together thus have a pot-like shape when assembled, onto which the vibration diaphragm is then placed as a "cover", so to speak, to provide the largely closed blower chamber.

Even integration of the vibration diaphragm is possible, for example by using 3D printing.

According to another embodiment of the vibration unit, the vibration plate and the wall are manufactured as separate components. The vibration plate can then be provided in particular as a flat, disk-shaped body to which a ring of a certain thickness is applied. The volume enclosed by the ring then defines the blower chamber. In this way, blower chambers of different heights can be easily produced, since only a ring of different thickness needs to be used in each case; the vibration plate can remain unchanged.

According to a further embodiment, the piezo actuator is arranged gas-tight with respect to the pump chamber. This means that the piezo actuator no longer comes into contact with the fluid to be pumped, since the volume in which it is located is sealed off. This can be achieved, for example, by designing the suspension to be continuous all the way around, or by providing an additional thin protective membrane that does not impede vibration. Thus, the gap between the wall of the vibration unit and the inner wall of the housing is circumferentially non-continuous; only the partial volume of the housing interior in which the piezo actuator is not located (pump chamber) comes into contact with the fluid.

It should be noted that even a design with non-separated partial volumes already leads to improved separation of the piezo actuator and the fluid to be conveyed, since the latter is not continuously fed past the former, but at best enters the corresponding half-space in small quantities without being constantly exchanged.

Preferably, the piezo actuator has a diameter of from 5 to 50 mm, and more preferably from 8 to 20 mm, and most preferably from 10 to 15 mm.

The gap between the wall and the inside of the housing is preferably smaller than 0.01 to 1 mm, and particularly preferably smaller than 0.5 mm.

The micropump, minus any ports, etc., preferably has a total height of 3 to 10 mm; it is particularly preferred that it is less than 8 mm high.

According to a further embodiment, the diameter of the blower opening is between 3.0 and 0.1 mm, and preferably between 2.0 and 0.3 mm, and particularly preferably between 0.5 mm and 0.7 mm.

The diameter of the suction opening(s) is preferably between 0.1 and 10.0 mm, and preferably between 0.2 and 5.0 mm, and particularly preferably between 0.5 mm and 2.5 mm.

The diameter of the output opening(s) is preferred to lie between 0.1 and 10.0 mm, and preferably between 0.25 and 5.0 mm, and particularly preferably between 0.7 and 0.9 mm.

Depending on the number of openings, this applies to each opening individually, or to the sum of the cross sections of the respective openings.

In the following, the use of the micropump according to the invention is described.

Accordingly, the method serves for pumping a compressible fluid such as, in particular, a gas using a micropump as defined above; to avoid repetition, reference is made to the corresponding passages above.

In a suction phase, the piezo actuator is controlled with a suitable voltage in such a way that it curves against the direction of the blower opening. This causes a vacuum to form in the blower chamber, which is propagated through the above-mentioned blower opening into the pump chamber, whereby fluid is drawn in through the suction opening.

In a subsequent output phase, however, the piezo actuator is controlled in such a way that it now curves in the direction of the blower opening. Alternatively, there is no (active) control, so that the piezo actuator returns to a typically flat rest position. This results in each case in that the negative pressure in the blower chamber is reduced, or in that even, measured against the ambient pressure, an overpressure is generated, which is also propagated through said blower opening into the pump chamber, whereby, utilizing the fluid dynamic effects described above, fluid is discharged through the output opening.

The rhythmic movement of the piezo actuator also causes the entire vibration unit to oscillate.

Accordingly, the preferred direction, i.e., suction through the suction opening, and discharge through the output opening, is achieved by the particular design of the micropump, in particular by the presence of the blower chamber, the blower opening, the oscillating movement of the vibration unit in relation to the housing surrounding it, and the arrangement of the suction and output opening.

The advantage of the method according to the invention is that, using the micropump according to the invention, it allows improved protection of the piezo actuator from undesirable external influences, since the fluid is conveyed only outside the half-space containing the piezo actuator. The suspension divides the interior of the housing into two half-spaces; one half-space contains the piezo actuator, the other half-space has suction and output opening(s) opening into it, and only this half-space is actively passed through by the conveyed fluid.

According to a preferred embodiment, the vibration plate also oscillates in the direction of movement of the piezo actuator, i.e., both plates move in approximately the same direction. In this way, improved generation of negative or positive pressure in the pump chamber can be achieved.

According to another, preferred embodiment, the vibration plate also oscillates, but in the opposite direction with respect to the direction of movement of the piezo actuator, i.e., both plates move at the same frequency, but just in opposite directions to each other. In this way, the vibration diaphragm and the vibration plate together with the wall form a kind of bellows, which alternates between a minimum and maximum volume of the blower chamber during each oscillation cycle. This results in a particularly strong inflow and outflow of the fluid into and out of the blower chamber.

DESCRIPTION OF THE DRAWINGS

The invention is explained below by way of example with the aid of figures, in which.

DETAILED DESCRIPTION OF PREFERRED EMBODIMENTS

Figure 1:
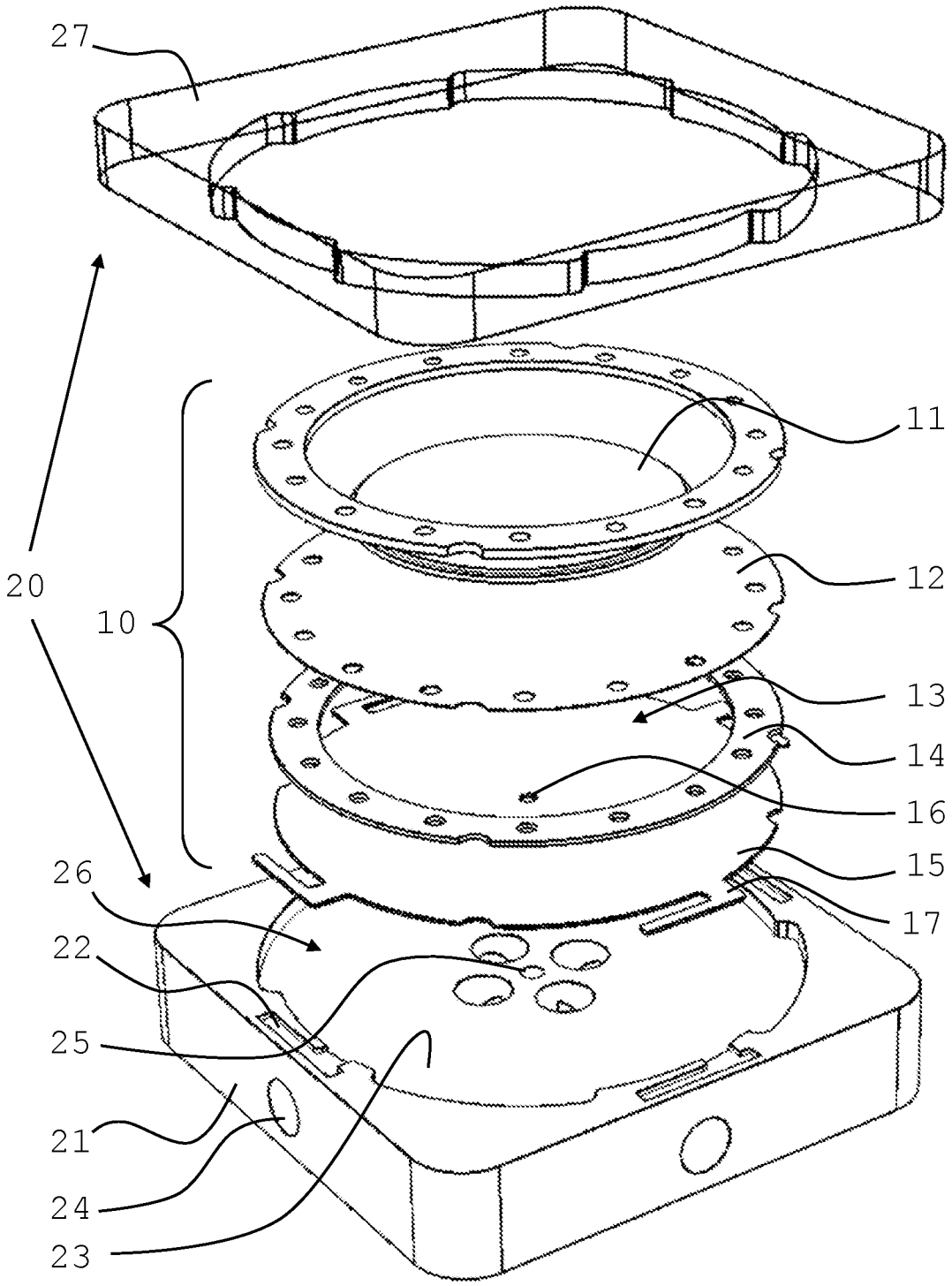
FIG. 1 is an exploded view of the main components of an embodiment of the micropump according to the invention.

FIG. 1 shows an exploded view of the main components of one embodiment of the micropump according to the invention.

Accordingly, the micropump comprises two main units. The first main unit is the vibration unit 10.

The vibration unit 10 comprises a disk-shaped piezo actuator 11, which is arranged on an outer side (pointing upwards in the picture) of an vibration diaphragm 12. A ring 14 of defined thickness is provided as a wall for the blower chamber 13. This is arranged on the vibration plate 15, which is opposite the inside of the vibration diaphragm 12. A centrally arranged blower opening 16 is located in the vibration plate 15. According to this embodiment, the vibration plate 15 and the wall (ring 14) are separate components.

Four suspensions 17 are arranged symmetrically at the side of the vibration plate 15 (only one is marked with a reference sign). By means of these, the remaining vibration unit 10 can oscillate at least, and preferably only, in (in the picture) vertical direction. The distal ends of the suspensions 17 can be inserted into correspondingly shaped receptacles 22 of the housing body 21 (likewise only one marked with a reference sign).

The second main unit is the housing 20.

The housing body 21 includes a recess 23 in which the components of the vibration unit 10 can be at least partially accommodated. Accordingly, a gap S (cf. e.g. next figure and the figure after next) is present between the vibration unit 10 and the inside of the housing 20, which ensures the required freedom of movement of the vibration unit 10. In the housing body 21 there are four suction openings 24 (only one is marked with a reference sign). These initially run radially to the main direction of movement of the vibration unit 10, which runs in the vertical direction in the figure. After a 90-degree bend (not visible, cf. next figure), they open into the pump chamber 26, from which an output opening 25 leads off centrally, opposite the blower opening 16.

The housing 20 further comprises a housing cover 27 which closes off the interior volume, comprising pump chamber 26 and half-space H, of the housing 20. In the present embodiment, the housing cover 27 is provided as a separate component which is connected to the housing body 21 in a gas-tight manner. In the embodiment shown, the housing cover 27 also has a recess (without reference sign) in which the components of the vibration unit 10 can also be accommodated at least partially.

Figure 2:
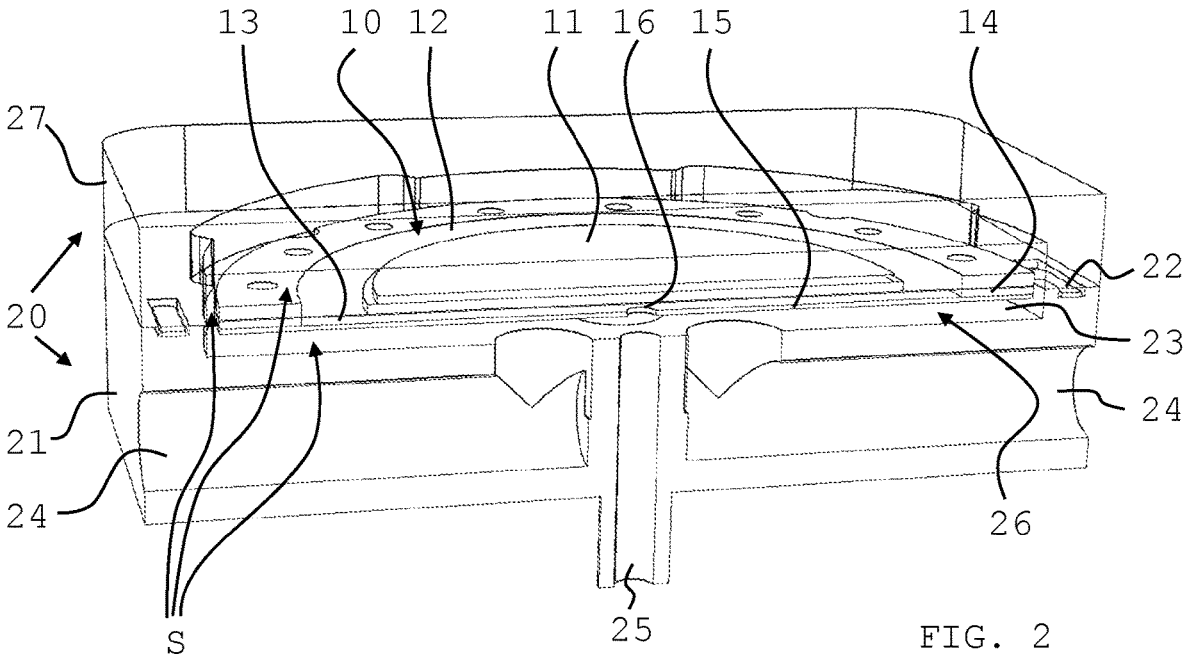
FIG. 2 is a sectional view through the assembly of this embodiment.

In FIG. 2, which shows a sectional view through the assembly of this embodiment, it can be seen that the housing 20 forms a closed space that also covers the piezo actuator 11 and thus protects it from environmental influences. For the sake of clarity, only some of the reference signs are shown.

The gap S surrounding the vibration unit 10 can also be seen, as well as the direction of the suction openings 24, which lead radially into the housing and, following a 90-degree curve, open vertically into the pump chamber 26.

If the depicted embodiment is mounted on a panel in an inverted position, none of the openings will be covered or closed by this panel.

According to an embodiment not shown, the housing body has only a single, preferably circumferential suction opening. The suction opening then runs parallel to the bottom of the pump chamber below the latter, and has at least one, but preferably several, openings into the pump chamber. In this way, the fluid resistance during inflow is particularly low.

Figure 3:
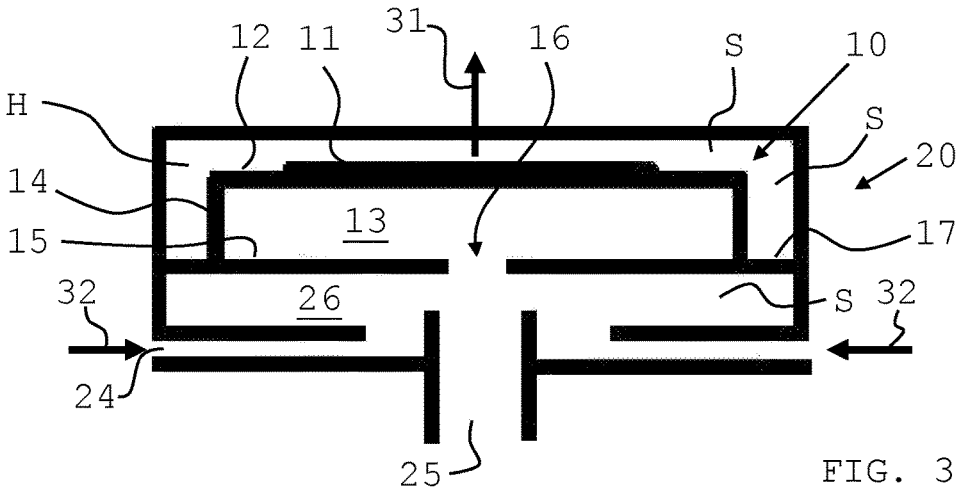
FIG. 3 is a schematic cross-section through this embodiment to illustrate the fluid paths.

Finally, FIG. 3 indicates the flow paths of the fluid during operation of the micropump. Again, only some of the reference signs are shown. According to this embodiment, the vibration plate 15 and the wall are manufactured in an integrated manner. The piezo actuator 11 is arranged gas-tight with respect to the pump chamber 26. In a suction phase, the vibration unit 10 moves in the direction of arrow 31. Consequently, a negative pressure is generated in the lower half-space that forms the pump chamber 26. This causes fluid (not shown) to flow in the direction of arrows 32 through the suction openings 24 into the pump chamber 26.

In an output phase, on the other hand, the vibration unit 10 moves in the direction opposite to the direction of arrow 31. This induces an increase in pressure in the pumping chamber 26, which results in fluid flowing out through the output opening 25.

As can be seen, the fluid is at all times conveyed outside the upper half-space H containing the piezo actuator 11, which in the present case lies above the vibration plate 15. Even if the suspension 17 is non-continuous, the fluid only moves back and forth a little in the half-space H, i.e. it is not exchanged and therefore does not "flow", which leads to a reduction of possible impairments of the piezo actuator by the fluid.

Figure 4:
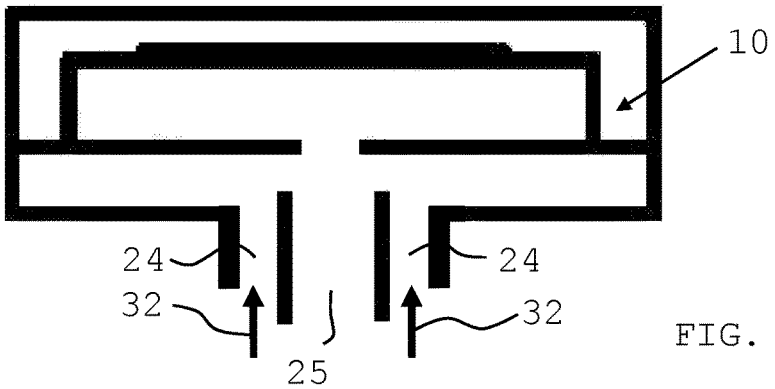
FIG. 4 is a schematic cross-section through an embodiment with an axial suction opening.

FIG. 4 shows a schematic cross-section of an embodiment with axial suction opening. Most reference signs have been omitted for clarity. The embodiment shown differs from that of FIG. 3 in that the suction opening 24 does not run radially, but extends in the axial direction. Accordingly, it runs approximately parallel to the output opening 25, and is located on an underside opposite the vibration unit 10. The lengths of both openings 24, 25 may be the same, but may also be different, as shown. The suction opening 24 can be multi-part, as shown in FIG. 1 and FIG. 2. It may also be configured as an annular opening.

Figure 5:
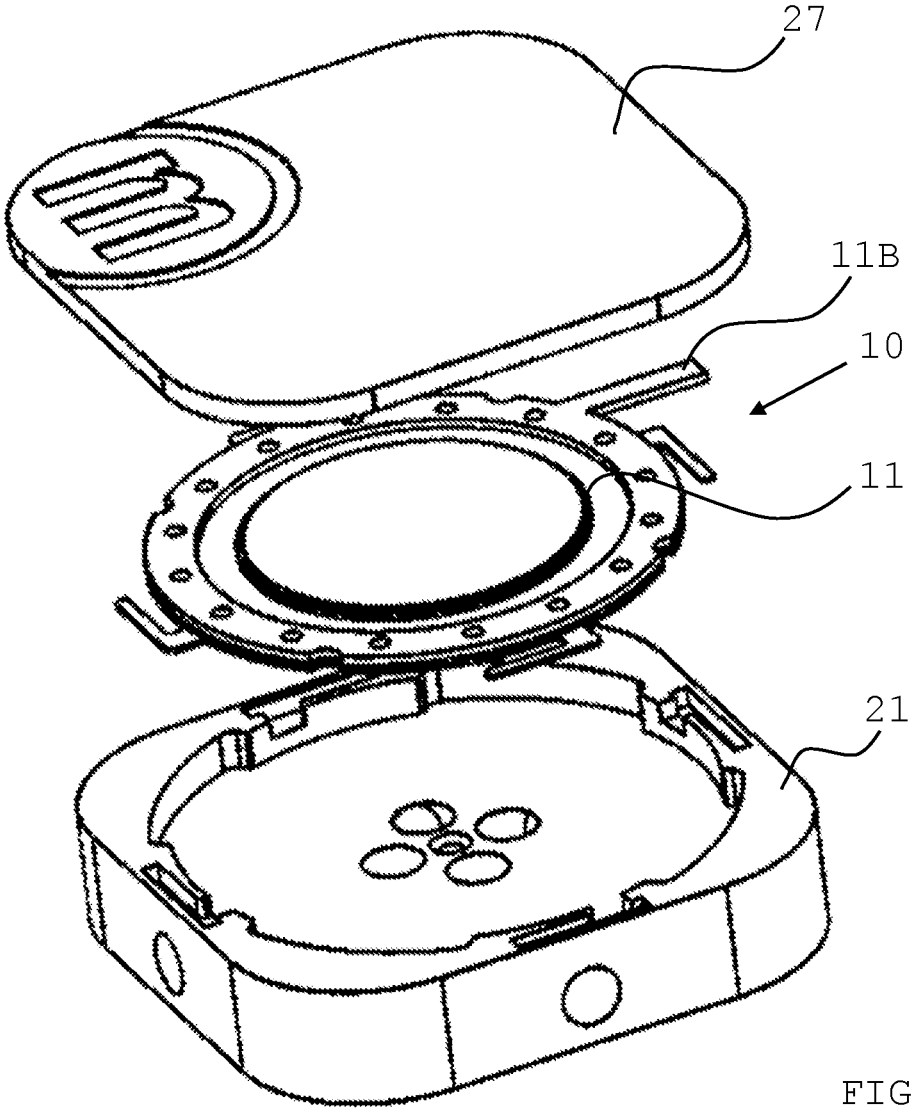
FIG. 5 is an exploded view of a further embodiment of the micropump according to the invention.
Figure 6:
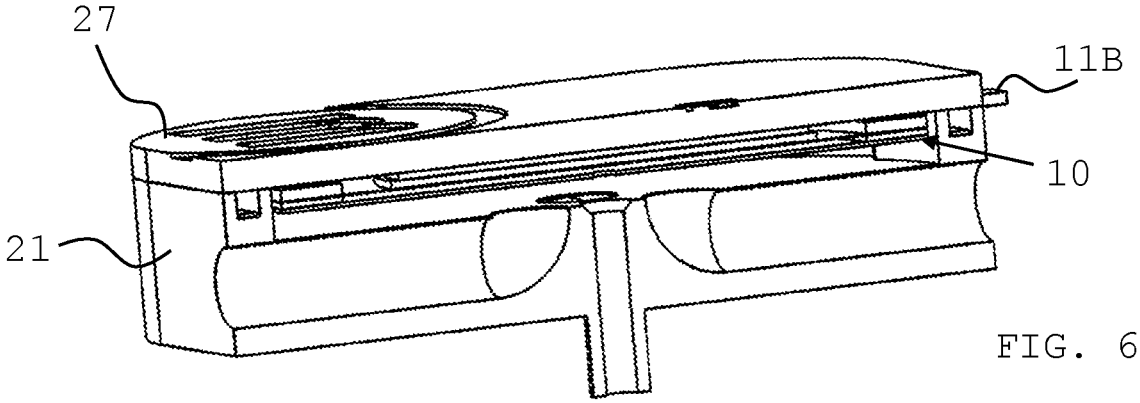
FIG. 6 is a sectional view through the assembly of this embodiment.

FIG. 5 shows an exploded view of a further embodiment of the micropump according to the invention. Here, as in the following figures, most of the reference signs have been omitted for reasons of clarity. FIG. 6 shows a sectional view of the embodiment of FIG. 5. In contrast to the embodiment of FIG. 1 and FIG. 2, a micropump according to this embodiment has a housing body 21 which is designed to accommodate all moving components including the gaps required for vibration. The housing cover 27 has a substantially flat design and, in particular, does not have any recesses on the inside for the internal components (vibration unit 10).

Also visible in FIG. 5 is an electrical connection 11B for the piezo actuator 11, which protrudes from the housing 10 after it has been assembled (FIG. 6).

Figure 7:
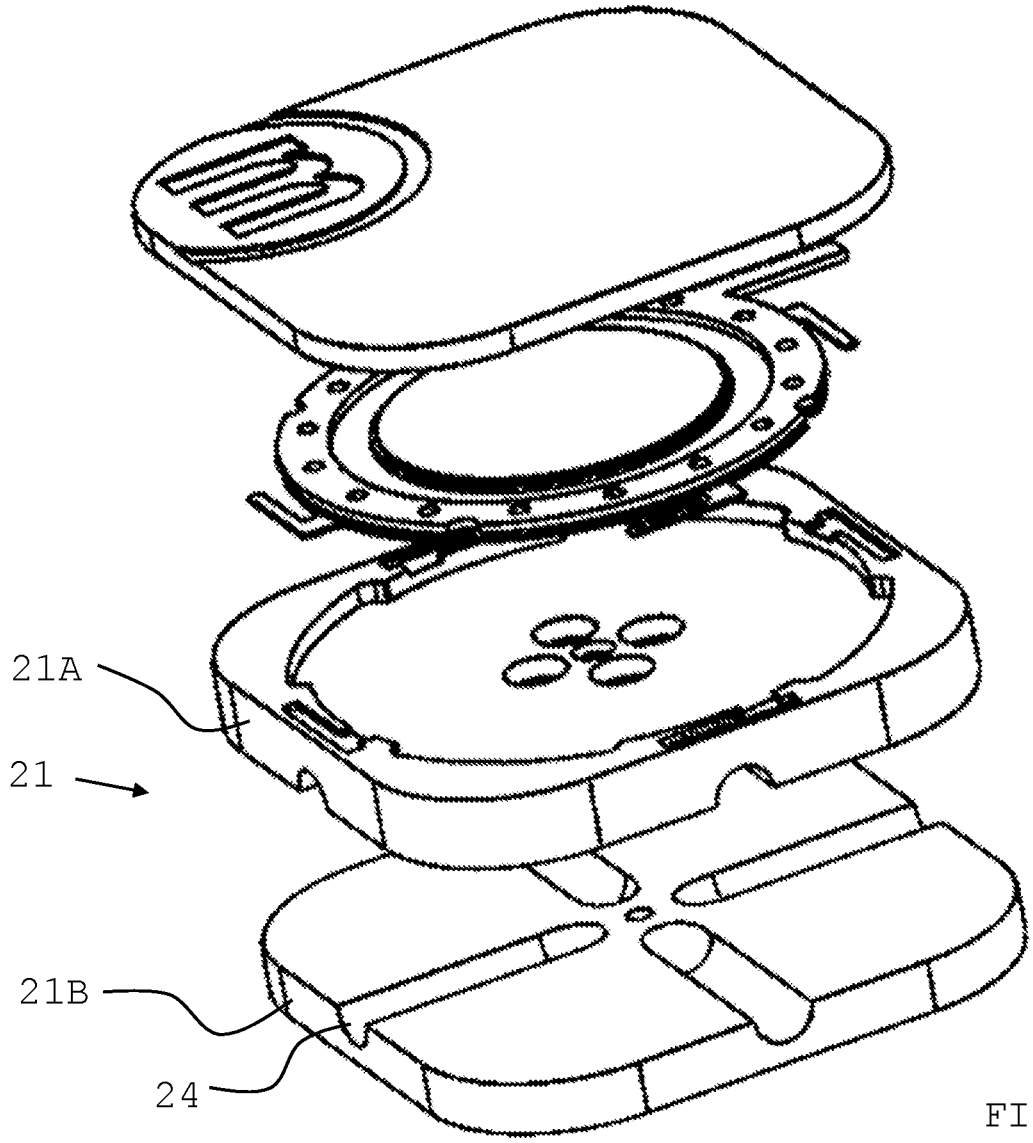
FIG. 7 is an exploded view of a further embodiment of the micropump according to the invention.
Figure 8:
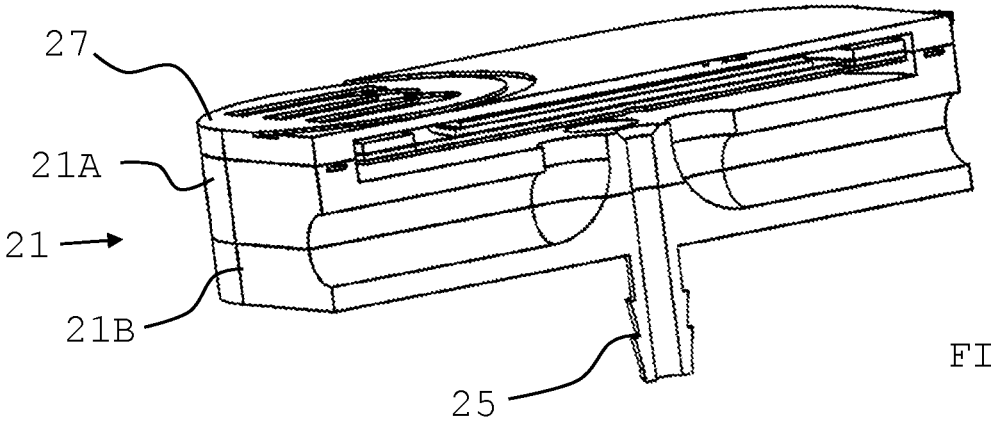
FIG. 8 is a sectional view through the assembly of this embodiment.

FIG. 7 and FIG. 8 show a further embodiment of the micropump. According to this embodiment, the housing 20 is made of two parts. It comprises a lower part 21A and an upper part 21B, both parts can be joined together, for example, by means of bonding or welding. Preferably, the connection is made in the course of connecting the other housing components such as, in particular, the cover 27. A two-part lower housing part 21 has the advantage that the suction openings 24 with the corresponding channels (only one marked with a reference sign) can be shaped in a more fluidically favorable manner (cf. the channels of FIG. 1 and FIG. 2, in particular the 90-degree curve).

The embodiment of FIG. 7 and FIG. 8 also shows a port of the output opening 25 prepared for insertion into a hose.

LIST OF REFERENCE SIGNS

10 vibration unit
11 piezo actuator
11B electrical connection
12 vibration diaphragm
13 blower chamber
14 ring
15 vibration plate
16 blower opening
17 suspension
20 housing
21 housing body
21A bottom part
21B top part
22 receptacle
23 recess
24 suction opening
25 output opening
26 pump chamber
27 housing cover
31,32 arrow
S gap
H space, half-space

What is claimed is:

1. A micropump for compressible fluids, the micropump comprising:

a vibration unit (10) comprising a disk-shaped piezo actuator (11) disposed on a vibration diaphragm (12), and a vibration plate (15) disposed on a side of the vibration diaphragm (12) that is opposite the piezo actuator (11), the vibration plate (15) having a blower opening (16) at its center and a circumferential wall connecting the vibration diaphragm (12) to the vibration plate (15) in a gas-tight manner so as to form a blower chamber (13); and a housing (20) in which the vibration unit (10) can be completely accommodated and in which it is oscillatingly mounted by means of at least one suspension (17), the housing (20) having a suction opening (24), as well as an output opening (25) which lies opposite the blower opening (16);

characterized in that the housing (20):

forms a closed half-space (H) covering the piezo actuator (11) to prevent exposure of the piezo actuator (11) to an environment outside of the micropump, and comprises a pump chamber (26) located on a side of the vibration plate (15) that is opposite the vibrating diaphragm (12) and which is fluidly connected to the suction opening (24) and the output opening (25) on a same plane, so that during oscillating operation of the piezo actuator (11) the vibration unit (10) is set to oscillate relative to the housing (20), whereby the compressible fluid can be sucked in through the suction opening (24) and discharged through the output opening (25), wherein the compressible fluid is prevented from contacting the piezo actuator (11).

2. The micropump of claim 1, wherein the housing (20) comprises a housing body (21) and a housing cover (27), and the housing body (21) is adapted to receive all moving components including gaps required for vibration.

3. The micropump of claim 1, wherein the housing (20) comprises a housing body (21) and a housing cover (27), and at least portions of the movable components are disposed in an interior recess of the housing cover (27).

4. The micropump according to claim 1, wherein the vibration plate (15) and circumferential wall are manufactured integrally.

5. The micropump according to claim 1, wherein the vibration plate (15) and the circumferential wall are manufactured as separate components.

6. The micropump according to claim 1, wherein the piezo actuator (11) is arranged in a gas-tight manner with respect to the pump chamber (26).

7. The micropump according to claim 1, wherein the piezo actuator (11) has a diameter of 5 to 50 mm, and/or a gap (S) between the circumferential wall and the inside of the housing (20) is smaller than 1 mm, and the micropump has a total height of 3 to 10 mm.

8. The micropump according to claim 1, wherein the diameter of the blower opening (16) is between 0.5 mm and 0.7 mm, and the diameter of the suction opening(s) (24) is between 0.5 mm and 2.5 mm, and the diameter of the outlet opening(s) (25) is between 0.7 and 0.9 mm.

9. The micropump of claim 1, wherein the vibration unit (10) is mounted to the at least one suspension unit (17) via the vibration plate (15).

10. A method of delivering a compressible fluid using the micropump as defined in claim 1, the method comprising:

controlling the piezo actuator (11) in a suction phase, in such a way that it curves against the direction of the blower opening (16), whereby a negative pressure is formed in the blower chamber (13) which is propagated through said blower opening (16) into the pump chamber (26), whereby fluid is drawn in through the suction opening (24) with the suction channel; and controlling the piezo actuator (11) in an output phase, in such a way that it curves in the direction of the blower opening (16) or goes into a flat rest position, whereby the negative pressure in the blower chamber (13) is reduced or an overpressure is generated, which also propagates through said blower opening (16) into the pump chamber (26), whereby fluid is emitted through the output opening (25), so that the vibration unit (10) is caused to oscillate, the compressible fluid being conveyed outside the half-space (H) containing the piezo actuator (11).

11. The method of claim 10, wherein the vibration plate (15) also oscillates in the direction of movement of the piezo actuator (11).

12. The method of claim 10, wherein the vibration plate (15) oscillates in opposition to the direction of motion of the piezo actuator (11).

* * * * *